US011933570B1

(12) United States Patent
Rogers et al.

(10) Patent No.: US 11,933,570 B1
(45) Date of Patent: Mar. 19, 2024

(54) WEAPON SLIDE COVER

(71) Applicant: Biofire Technologies Inc., Broomfield, CO (US)

(72) Inventors: Bryan Edward Rogers, Aurora, CO (US); Kai Thorin Kloepfer, Denver, CO (US); Donna Kelley, Louisville, CO (US); Benjamin William Dwyer, Golden, CO (US); Sara Elizabeth Falcone, Lafayette, CO (US)

(73) Assignee: Biofire Technologies Inc., Broomfield, CO (US)

( * ) Notice: Subject to any disclaimer, the term of this patent is extended or adjusted under 35 U.S.C. 154(b) by 0 days.

(21) Appl. No.: 17/810,884

(22) Filed: Jul. 6, 2022

Related U.S. Application Data

(60) Provisional application No. 63/218,649, filed on Jul. 6, 2021.

(51) Int. Cl.

| | |
|---|---|
| ***F41A 3/72*** | (2006.01) |
| ***F41A 3/66*** | (2006.01) |
| ***F41C 3/00*** | (2006.01) |
| ***F41G 11/00*** | (2006.01) |

(52) U.S. Cl.
CPC *F41A 3/72* (2013.01); *F41A 3/66* (2013.01); *F41C 3/00* (2013.01); *F41G 11/001* (2013.01)

(58) Field of Classification Search
CPC .... F41C 3/00; F41C 27/00; F41G 1/00; F41G 1/16; F41G 1/17; F41G 11/004; F41G 11/005
See application file for complete search history.

(56) References Cited

U.S. PATENT DOCUMENTS

| | | | | |
|---|---|---|---|---|
| 1,680,186 | A * | 8/1928 | Von Frommer | F41A 3/66 42/106 |
| 8,528,243 | B1 * | 9/2013 | Glock | F41A 3/66 42/75.02 |
| 9,587,911 | B2 * | 3/2017 | Wolf | F41G 1/02 |
| 10,753,710 | B2 * | 8/2020 | Niswander | F41G 11/003 |
| 10,871,350 | B1 * | 12/2020 | Thomas | F41G 1/16 |
| 2010/0175297 | A1 * | 7/2010 | Speroni | F41G 1/35 42/114 |
| 2011/0088539 | A1 * | 4/2011 | Oz | F41A 19/34 42/106 |
| 2011/0131859 | A1 * | 6/2011 | Lawson | F41G 11/004 42/90 |

(Continued)

*Primary Examiner* — Joshua E Freeman
(74) *Attorney, Agent, or Firm* — Perkins Coie LLP; Andrew T. Pettit

(57) ABSTRACT

The present disclosure provides systems and techniques that can be implemented in a gun. The gun may include or be coupled with a slide cover. The slide cover may include a first slide cover recess along a latitudinal axis of the slide cover, the first slide cover recess comprising a first cavity of a first portion of the slide cover and a first cavity of a second portion of the slide cover. The slide cover may include a second slide cover recess along the latitudinal axis of the slide cover, the second slide cover recess comprising a second cavity of the first portion of the slide cover and a second cavity of the second portion of the slide cover. The slide cover may include a first retainer coupling a sight component with the slide cover such that a longitudinal axis of the sight component is substantially parallel with a longitudinal axis of the slide cover.

19 Claims, 11 Drawing Sheets

(56) References Cited

U.S. PATENT DOCUMENTS

| | | | | |
|---|---|---|---|---|
| 2012/0198744 | A1* | 8/2012 | Meller | F41C 27/00 42/90 |
| 2013/0180152 | A1* | 7/2013 | Speroni | F41G 1/35 42/99 |
| 2014/0230305 | A1* | 8/2014 | Zimmer | F41C 3/00 42/111 |
| 2015/0354909 | A1* | 12/2015 | Tarantino | F41A 3/72 89/1.4 |
| 2017/0321977 | A1* | 11/2017 | Teitel | F41A 3/72 |
| 2018/0087871 | A1* | 3/2018 | Toner | F41G 1/16 |
| 2020/0278166 | A1* | 9/2020 | Adika | F41C 27/00 |

* cited by examiner

100

200

500

600

1000

1100

WEAPON SLIDE COVER

CROSS-REFERENCE TO RELATED APPLICATIONS

This application claims priority to U.S. Provisional Application No. 63/218,649, titled "WEAPON SLIDE COVER" and filed on Jul. 6, 2021, which is incorporated by reference herein in its entirety.

FIELD OF TECHNOLOGY

The teachings disclosed herein generally relate to guns, and more specifically to slide covers for guns.

BACKGROUND

The term "gun" generally refers to a ranged weapon that uses a shooting tube (also referred to as a "barrel") to launch solid projectiles, though some instead project pressurized liquid, gas, or even charged particles. These projectiles may be free flying (e.g., as with bullets), or these projectiles may be tethered to the gun (e.g., as with spearguns, harpoon guns, and electroshock weapons such as TASER® devices). The means of projectile propulsion vary according to the design (and thus, type of gun), but are traditionally effected pneumatically by a highly compressed gas contained within the barrel. This gas is normally produced through the rapid exothermic combustion of propellants (e.g., as with firearms) or mechanical compression (e.g., as with air guns). When introduced behind the projectile, the gas pushes and accelerates the projectile down the length of the barrel, imparting sufficient launch velocity to sustain it further towards a target after exiting the muzzle.

Most guns use compressed gas that is confined by the barrel to propel the projectile up to high speed, though the term "gun" may be used more broadly in relation to devices that operate in other ways. Accordingly, the term "gun" may not only cover handguns, shotguns, rifles, single-shot firearms, semi-automatic firearms, and automatic firearms, but also electroshock weapons, light-gas guns, plasma guns, and the like.

Significant energies have been spent developing safer ways to use, transport, store, and discard guns. Gun safety is an important aspect of avoiding unintentional injury due to mishaps like accidental discharges and malfunctions. Gun safety is also becoming an increasingly important aspect of designing and manufacturing guns. While there have been many attempts to make guns safer to use, transport, and store, those attempts have had little impact.

SUMMARY

The systems and techniques described herein support weapon slide covers. The term "gun," as used herein, may be used to refer to a lethal force weapon, such as a pistol, a rifle, a shotgun, a semi-automatic firearm, or an automatic firearm; a less-lethal weapon, such as a stun-gun or a projectile emitting device; or an assembly of components operable to selectively discharge matter or charged particles, such as a firing mechanism. The described systems, devices, and techniques provide a weapons slide cover, particularly in the context of guns. The described devices and components may include retaining pins, sight mounting components, and ergonomic features that support users in racking the slide.

The sight mounting components may support multiple types of sights, thereby improving weapon configuration and adaptability.

Generally, the systems and apparatuses described herein provide a weapon slide cover that includes multiple recesses, a grip portion, and a sight component. A recess may include two cavities, and a retaining component (e.g., a friction pin) may couple the slide cover to a weapon slide (e.g., a slide housing) while the retaining component is located in the recess. For example, the slide cover may include a first slide cover recess along a latitudinal axis of the slide cover, the first slide cover recess comprising a first cavity of a first portion of the slide cover and a first cavity of a second portion of the slide cover. The slide cover may include a second slide cover recess along the latitudinal axis of the slide cover, the second slide cover recess comprising a second cavity of the first portion of the slide cover and a second cavity of the second portion of the slide cover. The slide cover may include a first retainer coupling a sight component with the slide cover such that a longitudinal axis of the sight component is substantially parallel with a longitudinal axis of the slide cover.

Figure 1:
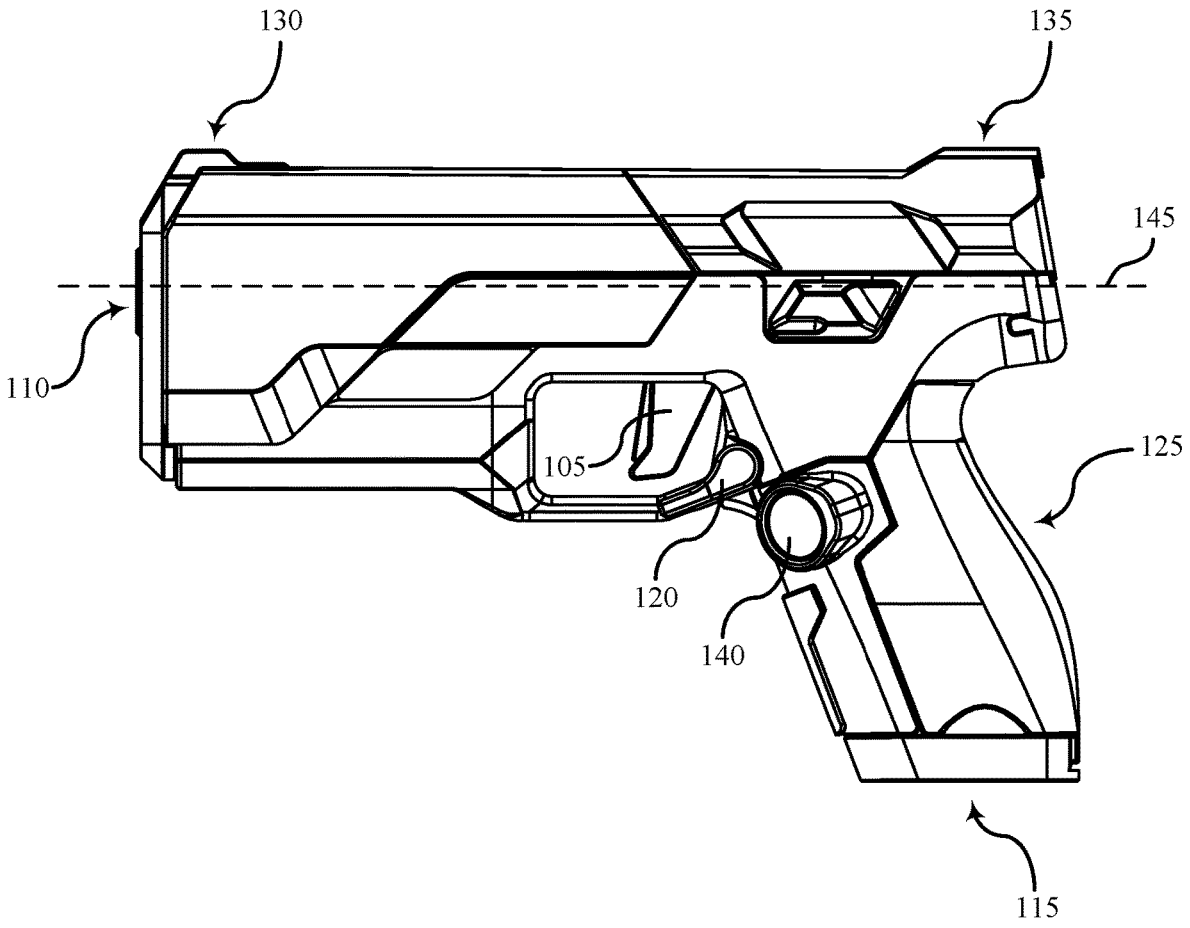
FIG. 1 illustrates an example of a gun that supports a weapon slide cover in accordance with aspects of the present disclosure.

Various features of the technology described herein will become more apparent to those skilled in the art from a study of the Detailed Description in conjunction with the drawings. Various embodiments are depicted in the drawings for the purpose of illustration. However, those skilled in the art will recognize that alternative embodiments may be employed without departing from the principles of the technology. Accordingly, the technology is amenable to modifications that may not be reflected in the drawings.

DETAILED DESCRIPTION

Some conventional guns include a slide that reciprocates in response to firing a projectile or an operator manually racking the slide. The slide, or components thereof, are often used to extract a spent cartridge from the chamber and feed a fresh cartridge into the chamber. Additionally, a slide may include aiming sights that assist in visually aligning the gun with a target. Conventional slides can be difficult to rack when moisture is present, and this difficulty can lead to delayed or failed cartridge loading. Additionally, conventional slides often provide fixed aiming sights that are difficult or impossible to modify.

Introduced here, therefore, is a slide cover that delivers an ergonomic grip and a system for mounting various types of sight components. As such, the slide cover described herein makes it easier to rack the slide while also delivering a sight component platform that supports the mounting of various types of aiming sights.

The systems described herein improve weapon slide management. For example, a slide cover may be coupled to a weapon slide, and the slide cover may improve slide management (e.g., using the slide cover to rack the slide) and weapon sight compatibility (e.g., coupling an aiming sight to the slide cover). The slide cover may include one or more recesses or cavities that support coupling the slide cover to a slide, coupling the slide cover to a breech block, or coupling a sight component (e.g., a sight, a sight rail, a sight mounting system, etc.) to the slide cover. The slide cover improves slide manipulation and supports multiple types of sights, thereby improving weapon functionality.

The slide cover may be configured to be mounted atop the slide in a longitudinal fashion based on one or more transverse friction pins. Generally, a longitudinal axis may be defined by the bore axis of the barrel of the gun. Using transverse friction pins provides a robust coupling (as force associated with slide recoil or racking is along the longitudinal axis of the slide and is perpendicular to the friction pins) while also supporting a quick take down procedure. The friction pins support a takedown procedure (e.g., as part of a field strip) with no or few additional tools, thereby improving ease of cleaning. A first friction pin may be located inside first and second cavities of a first recess, and a second friction pin may be located inside first and second cavities of a second recess. The first and second friction pins may capture one or more weapon components, such as a slide (or slide housing) and/or a breech block. The slide cover may include a removable sight component, which may support various sights and sight mounting systems. For example, one or more retainers (e.g., friction pins, screws, dowl pins, lynch pins, clevis pins, etc.) may be used to couple the sight component with the slide cover. In some cases, a sight (e.g., an iron sight) may be mounted to the slide cover, while in some other cases, a sight mounting system (e.g., a picatinny rail, a modular mount, etc.) may be mounted to the slide cover. The slide cover improves the gun ergonomics while supporting multiple types of sights.

Embodiments may be described in the context of executable instructions for the purpose of illustration. For example, a processor housed in a gun may be described as being capable of executing instructions that permit controlling electronic components, such as an electronic aiming sight that is located on a slide cover. However, those skilled in the art will recognize that aspects of the technology could be implemented via hardware, firmware, or software.

Terminology

References in the present disclosure to "an embodiment" or "some embodiments" means that the feature, function, structure, or characteristic being described is included in at least one embodiment. Occurrences of such phrases do not necessarily refer to the same embodiment, nor do they necessarily refer to alternative embodiments that are mutually exclusive of one another.

Unless the context clearly requires otherwise, the terms "comprise," "comprising," and "comprised of" are to be construed in an inclusive sense rather than an exclusive or exhaustive sense (i.e., in the sense of "including but not limited to"). The term "based on" is also to be construed in an inclusive sense rather than an exclusive or exhaustive sense. For example, the phrase "A is based on B" does not imply that "A" is based solely on "B." Thus, the term "based on" is intended to mean "based at least in part on" unless otherwise noted.

The terms "connected," "coupled," and variants thereof are intended to include any connection or coupling between two or more elements, either direct or indirect. The connection or coupling can be physical, electrical, logical, or a combination thereof. For example, elements may be electrically or communicatively coupled with one another despite not sharing a physical connection. As one illustrative example, a first component is considered coupled with a second component when there is a conductive path between the first component and the second component. As another illustrative example, a first component is considered coupled with a second component when the first component and the second component are fastened, joined, attached, tethered, bonded, or otherwise linked.

The term "manager" may refer broadly to software, firmware, or hardware. Managers are typically functional components that generate one or more outputs based on one or more inputs. A computer program may include or utilize one or more managers. For example, a computer program may utilize multiple managers that are responsible for completing different tasks, or a computer program may utilize a single manager that is responsible for completing all tasks. As another example, a manager may include an electrical circuit that produces an output based on hardware components, such as transistors, logic gates, analog components, or digital components. Unless otherwise noted, the terms "manager" and "module" may be used interchangeably herein.

When used in reference to a list of multiple items, the term "or" is intended to cover all of the following interpretations: any of the items in the list, all of the items in the list, and any combination of items in the list. For example, the list "A, B, or C" indicates the list "A" or "B" or "C" or "A and B" or "A and C" or "B and C" or "A and B and C."

Overview of Guns

FIG. 1 illustrates an example of a gun 100 that supports a slide cover which may be mounted to the slide of the gun 100. The gun 100 includes a trigger 105, a barrel 110, a magazine 115, and a magazine release 120. While these components are generally found in firearms, such as pistols, rifles, and shotguns, those skilled in the art will recognize that the technology described herein may be similarly applicable to other types of guns as discussed above. As an example, comparable components may be included in vehicle-mounted weapons that are not intended to be held or operated by hand. While not shown in FIG. 1, the gun 100 may also include a striker (e.g., a ratcheting striker or rotating striker) or a hammer that can be actuated in response to pulling the trigger 105. Pulling the trigger 105 may result in the release of the striker or hammer, thereby causing the striker or hammer to contact a firing pin, percussion cap, or primer, so as to ignite a propellant and fire a projectile through the barrel 110. Embodiments of the gun 100 may also include a blowback system, a locked breech system, or any combination thereof. These systems are more commonly found in self-reloading firearms. The blowback system may be responsible for obtaining energy from the motion of the case of the projectile as it is pushed to the rear of the gun 100 by expanding propellant, while the locked breech system may be responsible for slowing down the opening of the breech of a self-reloading firearm when fired. Accordingly, the gun 100 may support the semi-automatic firing of projectiles, the automatic firing of projectiles, or both.

The gun 100 may include one or more safeties that are meant to reduce the likelihood of an accidental discharge or an unauthorized use. The gun 100 may include one or more mechanical safeties, such as a trigger safety or a firing pin safety. The trigger safety may be incorporated in the trigger 105 to prevent the trigger 105 from moving in response to lateral forces placed on the trigger 105 or dropping the gun. The term "lateral forces," as used herein, may refer to a force that is substantially orthogonal to a central axis 145 that extends along the barrel 110 from the front to the rear of the gun 100. The central axis 145 is an example of a longitudinal axis. The firing pin safety may block the displacement path of the firing pin until the trigger 105 is pulled. Additionally or alternatively, the gun 100 may include one or more electronic safety components, such as an electronically actuated drop safety. In some cases, the gun 100 may include both mechanical and electronic safeties to reduce the potential for an accidental discharge and enhance the overall safety of the gun 100.

The gun 100 may include one or more sensors, such as a user presence sensor 125 and a biometric sensor 140. In some cases, the gun 100 may include multiple user presence sensors 125 whose outputs can collectively be used to detect the presence of a user. For example, the gun 100 may include a time of flight (TOF) sensor, a photoelectric sensor, a capacitive sensor, an inductive sensor, a force sensor, a resistive sensor, or a mechanical switch. As another example, the gun 100 may include a proximity sensor that is configured to emit an electromagnetic field or electromagnetic radiation, like infrared, and looks for changes in the field or return signal. As another example, the gun 100 may include an inertial measurement unit (IMU) configured to identify a presence event in response to measuring movement that matches a movement signature of a user picking up the gun 100. As another example, the gun 100 may include an audio input mechanism (e.g., a transducer implemented in a microphone) that is configured to generate a signal that is representative of nearby sounds, and the presence of the user can be detected based on an analysis of the signal.

The gun 100 may also include one or more biometric sensors 140 as shown in FIG. 1. For example, the gun 100 may include a fingerprint scanner (also referred to as a "fingerprint scanner"), an image sensor, or an audio input mechanism. The fingerprint scanner may generate a digital image (or simply "image") of the fingerprint pattern of the user, and the fingerprint pattern can be examined (e.g., on the gun 100 or elsewhere) to determine whether the user should be verified. The image sensor may generate an image of an anatomical feature (e.g., the face or eye) of the user, and the image can be examined (e.g., on the gun 100 or elsewhere) to determine whether the user should be verified. Normally, the image sensor is a charge-coupled device (CCD) or complementary metal-oxide semiconductor (CMOS) sensor that is included in a camera module (or simply "camera") able to generate color images. The image sensor need not necessarily generate images in color, however. In some embodiments, the image sensor is configured to generate ultraviolet, infrared, or near infrared images. Regardless of its nature, images generated by the image sensor can be used to authenticate the presence or identity of the user. As an example, an image generated by a camera may be used to perform facial recognition of the user. The audio input mechanism may generate a signal that is representative of audio containing the voice of the user, and the signal can be examined (e.g., on the gun 100 or elsewhere) to determine whether the user should be verified. Thus, the signal generated by the audio input mechanism may be used to perform speaker recognition of the user. Including multiple biometric sensors in the gun 100 may support a robust authentication procedure that functions in the event of sensor failure, thereby improving gun reliability. Note, however, that each of the multiple biometric sensors may not provide the same degree or confidence of identity verification. As an example, the output produced by one biometric sensor (e.g., an audio input mechanism) may be used to determine whether a user is present while the output produced by another biometric sensor (e.g., a fingerprint scanner or image sensor) may be used to verify the identity of the user in response to a determination that the user is present.

The gun 100 may include one or more components that facilitate the collection and processing of token data. For example, the gun 100 may include an integrated circuit (also referred to as a "chip") that facilitates wireless communication. The chip may be capable of receiving a digital identifier, such as a Bluetooth® token or a Near Field Communication (NFC) identifier. The term "authentication data" may be used to describe data that is used to authenticate a user. For example, the gun 100 may collect authentication data from the user to determine that the user is authorized to operate the gun 100, and the gun 100 may be unlocked based on determining that the user is authorized to operate the gun 100. Authentication data may include biometric data, token data, or both. Authentication data may be referred to as enrollment data when used to enroll a user, and authentication data may be referred to as query data when used to authenticate a user. In some examples, the gun may transform (e.g., encrypt, hash, transform, encode, etc.) enrollment data and store the transformed enrollment data in memory (e.g., non-volatile memory) of the gun, and the gun may discard or refrain from storing query data in the memory. Thus, the gun 100 may transform authentication data, so as to inhibit unauthenticated use even in the event of unauthorized access of the gun.

The gun 100 may support various types of aiming sights (or simply "sights"). At a high level, a sight is an aiming device that may be used to assist in visually aligning the gun 100 (and, more specifically, its barrel 110) with a target. For example, the gun 100 may include iron sights that improve aim without the use of optics. Additionally or alternatively, the gun 100 may include telescopic sights, reflex sights, or laser sights. In FIG. 1, the gun 100 includes two sights—namely, a front sight 130 and a rear sight 135. In some cases, the front sight 130 or the rear sight 135 may be used to indicate gun state information. For example, the front sight 130 may include a single illuminant that is able to emit light of different colors to indicate different gun states. As another example, the front sight 130 may include multiple illuminants, each of which is able to emit light of a different color, that collectively are able to indicate different gun states. One example of an illuminant is a light-emitting diode (LED).

The gun 100 may fire projectiles, and the projectiles may be associated with lethal force or less-lethal force. For example, the gun 100 may fire projectiles containing lead, brass, copper, zinc, steel, plastic, rubber, synthetic polymers (e.g., nylon), or a combination thereof. In some examples, the gun 100 is configured to fire lethal bullets containing lead, while in other cases the gun 100 is configured to fire less-lethal bullets containing rubber. As mentioned above, the technology described herein may also be used in the context of a gun that fires prongs (also referred to as "darts") which are intended to contact or puncture the skin of a target and then carry electric current into the body of the target. These guns are commonly referred to as "electronic control weapons" or "electroshock weapons." One example of an electroshock weapon is a TASER device.

The rear sight 135 may be coupled with a slide cover, and the slide cover may be coupled with a slide (e.g., a slide housing). The slide cover may provide one or more regions (e.g., textured regions, recessed regions, protruding regions, etc.) for a user to grip, thereby improving the ease by which the user can displace the slide along a longitudinal axis (e.g., an axis substantially parallel with the barrel 110). In some cases, the rear sight 135 may be removed, and another sight (e.g., a telescopic sight, a red dot sight, a holographic sight, etc.) may be mounted to the slide cover.

The slide cover may include a first recess along a latitudinal axis of the slide cover, the first recess comprising a first cavity of a first portion of the slide cover and a first cavity of a second portion of the slide cover. The slide cover may include a second recess along the latitudinal axis of the slide cover, the second recess comprising a second cavity of the first portion of the slide cover and a second cavity of the second portion of the slide cover. The slide cover may include a first retainer coupling a sight component (e.g., the rear sight 135) with the slide cover such that a longitudinal axis of the sight component is substantially parallel with a longitudinal axis of the slide cover. The longitudinal axis of the slide cover may be substantially parallel to the barrel 110. The slide cover may include a second retainer coupling the sight component with the slide cover, and the second retainer may be substantially perpendicular to the first retainer.

Figure 2:
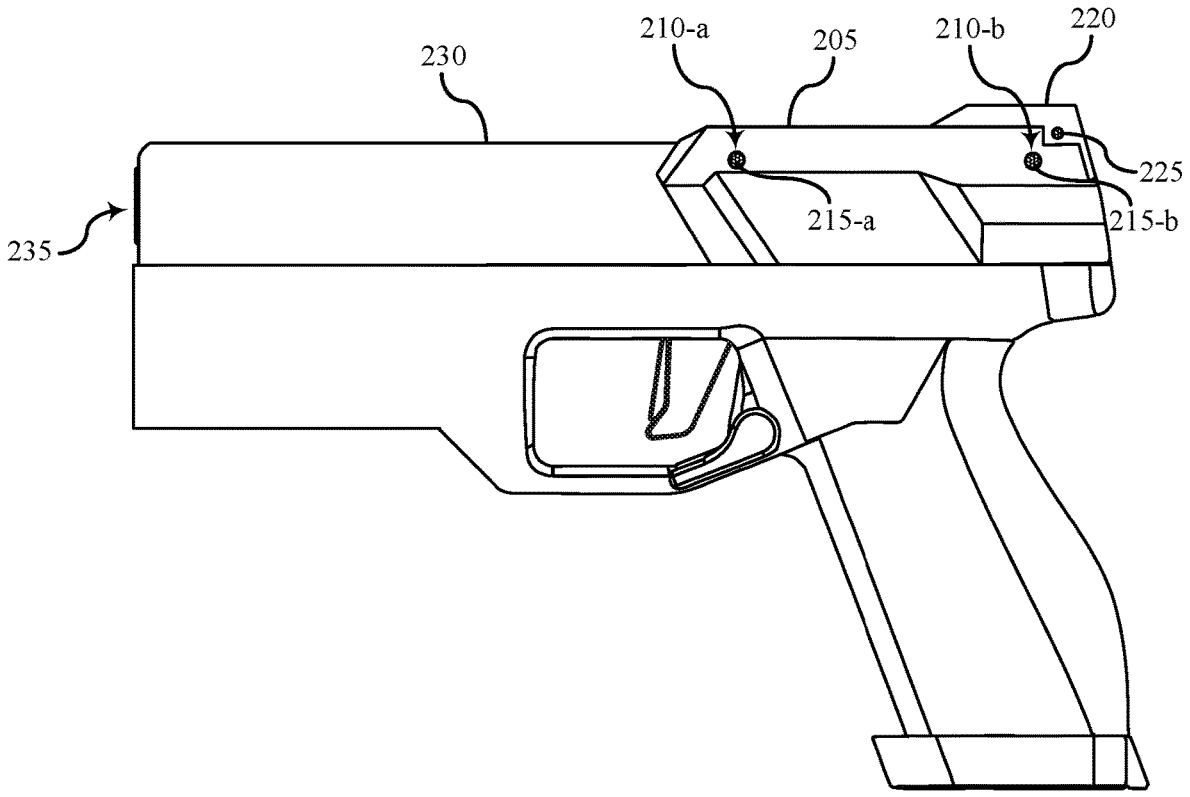
FIG. 2 illustrates an example of a gun that supports a weapon slide cover in accordance with aspects of the present disclosure.

FIG. 2 illustrates an example of a gun 200 that includes a slide cover 205. The slide cover 205 includes a first recess 210-*a*, a second recess 210-*b*, a first retaining pin 215-*a*, a second retaining pin 215-*b*, a sight component 220, a retainer 225, a slide component 230 (e.g., a slide housing), and a barrel 235. The sight component 220 is shown as an iron sight, but it should be understood that a sight component may include other components, as described herein.

In some examples, the first retaining pin 215-*a* and the second retaining pin 215-*b* may be friction pins that couple the slide cover 205 with the slide component 230 (e.g., a slide, a slide housing, etc.). A dimension (e.g., a radius, a diameter, a circumference) of a retaining pin (e.g., the first retaining pin 215-*a* and/or the second retaining pin 215-*b*) and a dimension of a recess (e.g., the first recess 210-*a* and/or the second recess 210-*b*) may satisfy a coupling condition. For example, the difference between the dimension of the retaining pin and the dimension of the recess may be less than a threshold (e.g., 1 centimeter (cm), 1 millimeter (mm), 0.5 mm, 0.1 mm, etc.). The first recess 210-*a* and the second recess 210-*b* may include the same or different properties. The first recess 210-*a* and the first retaining pin 215-*a* may satisfy a first coupling condition, and the second recess 210-*b* and the second retaining pin 215-*b* may satisfy a second coupling that is the same as the first coupling condition or different from the first coupling condition.

The retaining pins (e.g., the first retaining pin 215-*a* and the second retaining pin 215-*b*) may couple the slide cover 205 with the slide component 230, with a breechblock, or with both. The breechblock may be coupled with a striker and/or extractor. As such, displacing the slide cover 205 may cause displacement of the slide component 230 and the breechblock, so a user may displace the slide cover 205 to perform various functions, such as racking the slide component 230, placing the gun 200 in battery, or extracting a cartridge from the chamber.

Figure 3:
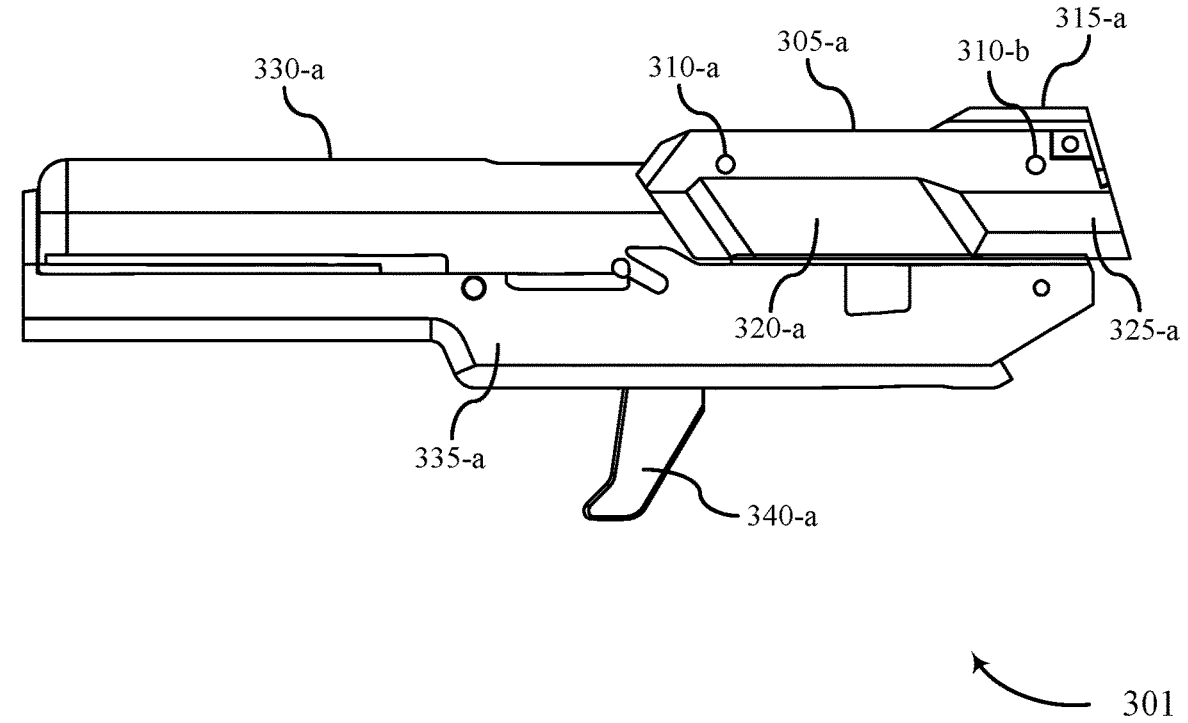
FIG. 3 illustrates an example of gun components that support a weapon slide cover in accordance with aspects of the present disclosure.
Figure 3:
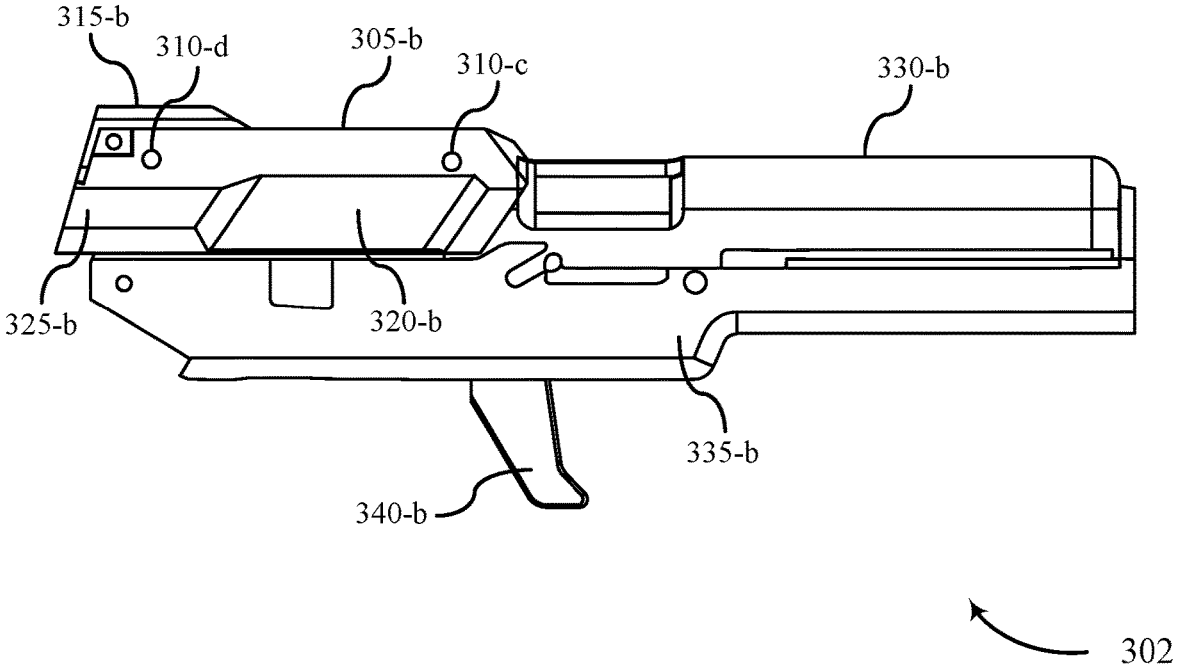

FIG. 3 illustrates an example of a left-side view 301 of gun components and an example of a right-side view 302 of gun components. The left-side view 301 of the gun components includes a slide cover 305-*a*, a first recess 310-*a*, a second recess 310-*b*, a sight 315-*a* (e.g., a sight component), a grip portion 320-*a*, a rearward portion 325-*a*, a slide 330-*a* (e.g., a slide component), a frame 335-*a*, and a trigger 340-*a*.

The grip portion 320-*a* may be convex or concave with respect to the rearward portion 325-*a*. In some examples, the grip portion 320-*a* may be convex and protrude further (e.g., laterally, out of the page) than the rearward portion 325-*a*, while in some other examples, the grip portion 320-*a* may be concave and be recessed further (e.g., laterally, into the page) than the rearward portion 325-*a*. For example, the grip portion 320-*a* may be convex and protrude away from a longitudinal axis defined by a bore axis of the barrel, or the grip portion 320-*a* may be concave and be recessed towards the longitudinal axis defined by the bore axis of the barrel.

The grip portion 320-*a* may include a different texture and/or frictional coefficient than the rearward portion 325-*a*. In other words, the grip portion 320-*a* may be at a different location laterally than another portion of slide cover 305-*a* (e.g., the rearward portion 325-*a*), and the grip portion 320-*a* may be of a higher friction coefficient than another portion of the slide cover 305-*a* (e.g., the rearward portion 325-*a*), thereby making it easier for an operator to rack and manage the slide 330-*a*.

The right-side view 302 of the gun components includes a slide cover 305-*b*, a first recess 310-*c*, a second recess 310-*d*, a sight 315-*b* (e.g., a sight component), a grip portion 320-*b*, a rearward portion 325-*b*, a slide 330-*b* (e.g., a slide component), a frame 335-*b*, and a trigger 340-*b*.

The grip portion 320-*b* may be convex or concave with respect to the rearward portion 325-*b*. In some examples, the grip portion 320-*b* may be convex and protrude further (e.g., laterally, out of the page) than the rearward portion 325-*b*, while in some other examples, the grip portion 320-*b* may be concave and be recessed further (e.g., laterally, into the page) than the rearward portion 325-*b*. The grip portion 320-*b* may be of a different texture and/or frictional coefficient as compared to a different portion of the of the slide cover 305-*b* (e.g., the rearward portion 325-*b*).

Figure 4:
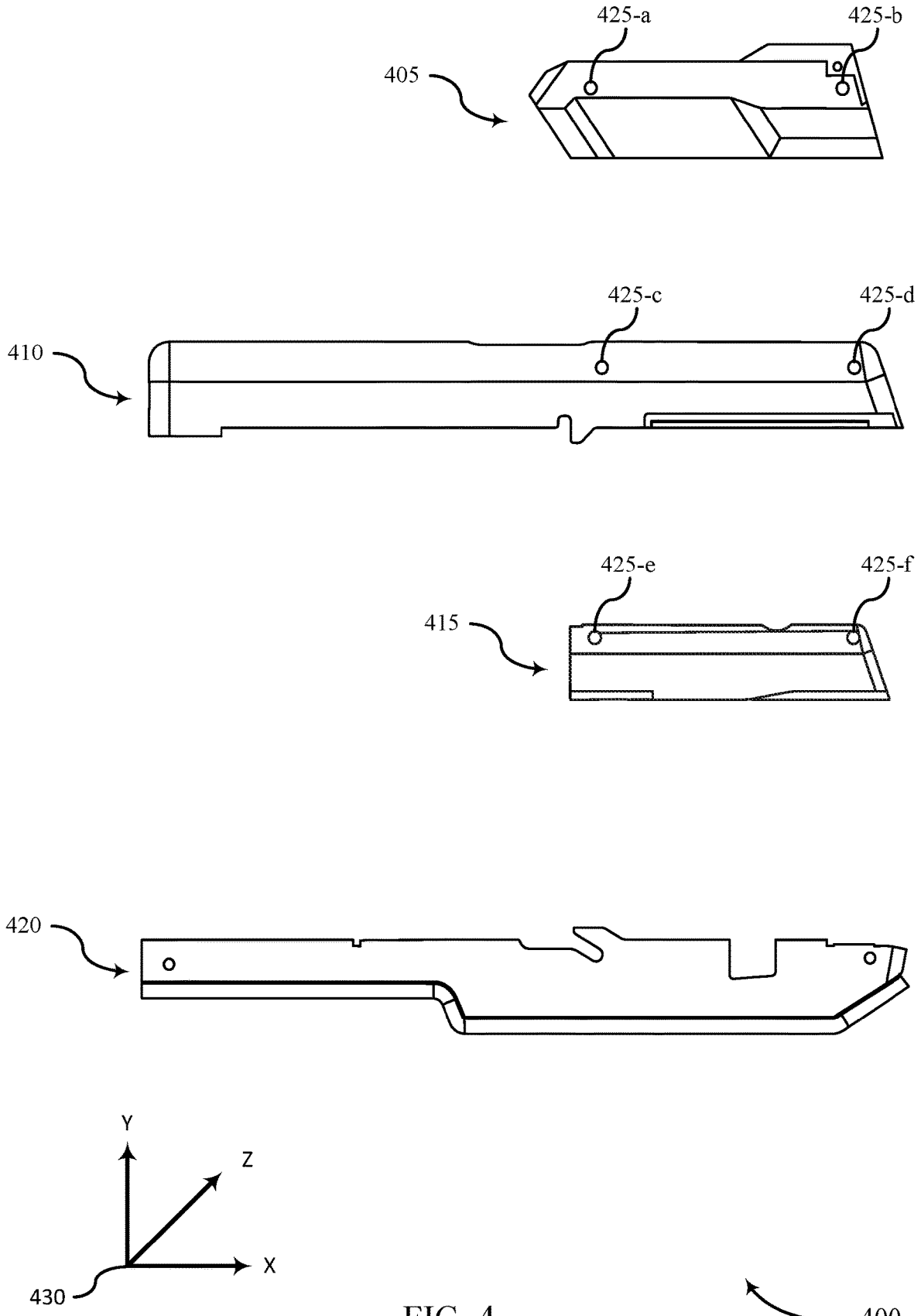
FIG. 4 illustrates an example of an exploded view of gun components that support a weapon slide cover in accordance with aspects of the present disclosure.

FIG. 4 illustrates an example of an exploded view 400 of gun components. The exploded view 400 includes a slide cover 405, a slide 410 (e.g., a slide component, a slide housing, etc.), a breechblock 415, a frame 420, multiple apertures (which may also be referred to as "cavities" or "recesses"), and a legend 430. In some examples, a recess may include two cavities that are aligned. The longitudinal axis of the slide cover 405 is along the x-axis of the legend 430, and the latitudinal axis of the slide cover 405 is along the z-axis of the legend 430. The first recess is a lateral recess that includes the cavity 425-*a* and a complimentary cavity that is not shown. The second recess is a lateral recess that includes the cavity 425-*b* and a complimentary cavity that is not shown.

The slide 410 includes a cavity 425-*c* and a complimentary cavity that is not shown, as well as a cavity 425-*d* and a complimentary cavity that is not shown. The breechblock 415 includes a cavity 425-*e* and a complimentary cavity that is not shown, as well as a cavity 425-*f* and a complimentary cavity that is not shown.

When assembled together, a first retaining component (e.g., a friction pin) may travel along the z-axis through the cavity 425-*a*, the cavity 425-*c*, the cavity 425-*e*, a complimentary cavity to the cavity 425-*e*, a complimentary cavity to the cavity 425-*c*, and a complimentary cavity to the cavity 425-*a*. In other words, the cavity 425-*a*, the cavity 425-*c*, and the cavity 425-*e* may line up along the x-axis and the y-axis such that a straight retaining component may be located inside the cavity 425-*a*, the cavity 425-*c*, and the cavity 425-*e*. A second retaining component (e.g., a friction pin) may travel along the z-axis through the cavity 425-*b*, the cavity 425-*d*, the cavity 425-*f*, a complimentary cavity to the cavity 425-*f*, a complimentary cavity to the cavity 425-*d*, and a complimentary cavity to the cavity 425-*b*. In other words, the cavity 425-*b*, the cavity 425-*d*, and the cavity 425-*f* may line up along the x-axis and the y-axis such that a straight retaining component may be located inside the cavity 425-*b*, the cavity 425-*d*, and the cavity 425-*f*.

Figure 5:
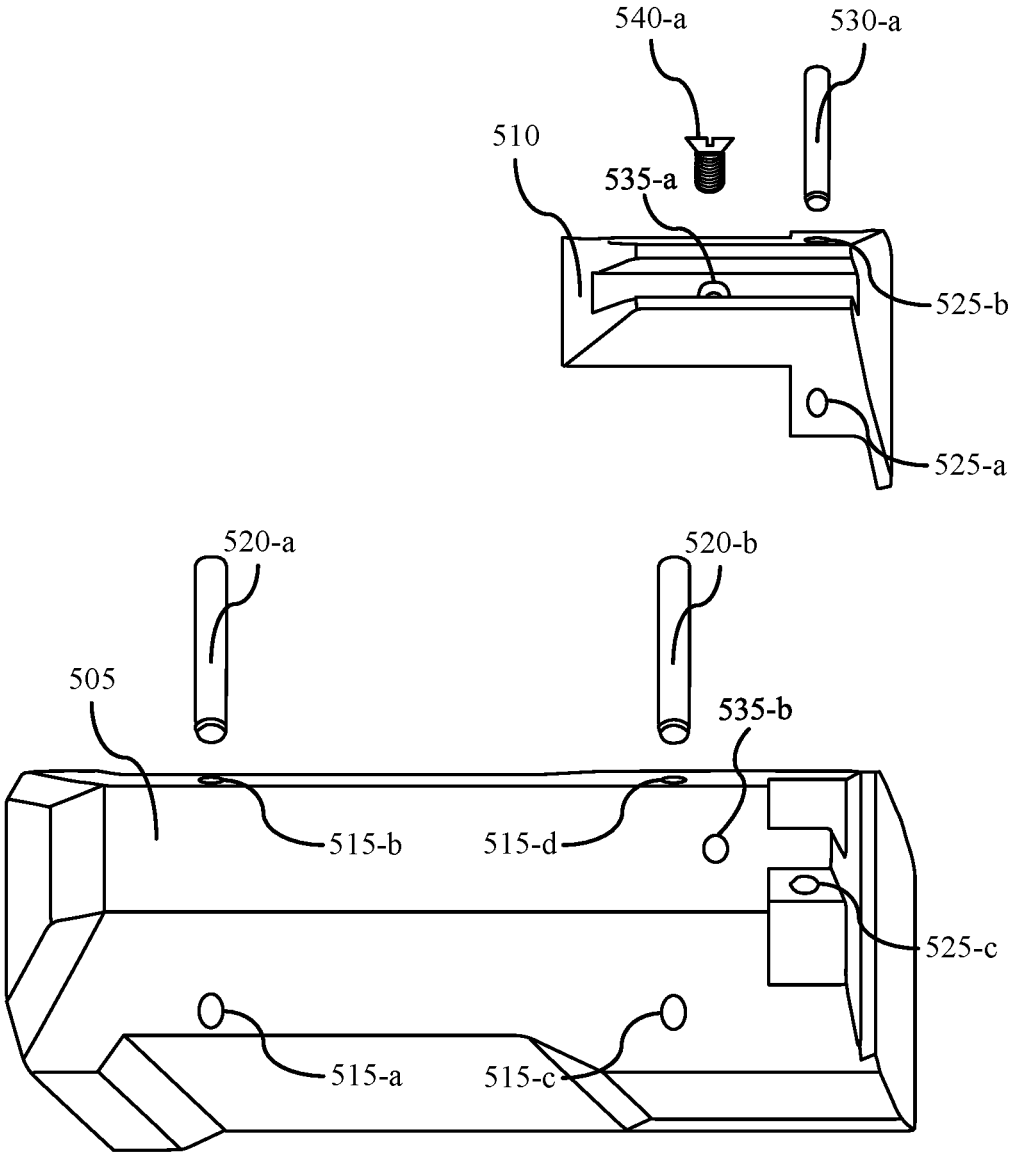
FIG. 5 illustrates an example of an exploded view of a slide cover that supports a weapon slide cover in accordance with aspects of the present disclosure.

FIG. 5 illustrates an example of an exploded view 500 of a slide cover. The exploded view 500 includes the slide cover 505, the sight component 510, multiple cavities (e.g., a cavity 515-*a*, a cavity 515-*b*, a cavity 515-*c*, a cavity 515-*d*, a cavity 525-*a*, a cavity 525-*b*, a cavity 525-*c*, a cavity 535-*a*, and a cavity 535-*b*), and multiple retainers (e.g., a retainer 520-*a*, a retainer 520-*b*, a retainer 530-*a*, and a retainer 540-*a*). The sight component 510 is an example of an iron sight (a rear iron sight, an open sight, an aperture sight, etc.) that may be coupled with the slide cover 505, but it should be understood that various types of sight components (e.g., sight mounting components, picatinny rails, telescopic sights, red dot sights reflex sights, holographic sights, etc.) may be coupled with slide cover 505. The sight component 510 is an example of a slide cover component that may be affixed to the slide cover 505.

In some cases, a slide cover 505 may include a sight component 510. For example, while the sight component 510 is coupled with the slide cover 505, the sight component 510 may be considered part of the slide cover 505. In some other cases, the slide cover 505 may not include the sight component 510. For example, a user may remove the sight component from the slide cover by removing the retainer 530-*a* and/or the retainer 540-*a*.

The retainer 520-*a* may be located inside the cavity 515-*a* as well as the cavity 515-*b*, in a region of the slide cover 505 that may be referred to as a recess. The retainer 520-*a* may couple the slide cover 505 to a slide, a breech block, or another gun component. The retainer 520-*b* may be located inside the cavity 515-*c* as well as the cavity 515-*d*, in a region of the slide cover 505 that may be referred to as a recess. The retainer 520-*b* may couple the slide cover 505 to a slide, a breech block, or another gun component. The slide cover 505 may include a longitudinal axis running along the length of the slide cover (e.g., an axis formed by drawing a line between the cavity 515-*a* and the cavity 515-*c* or by drawing a line between the cavity 515-*b* and the cavity 515-*d*). The slide cover 505 may include a latitudinal axis that is transverse to the longitudinal axis (e.g., an axis formed by drawing a line between the cavity 515-*a* and the cavity 515-*b* or by drawing a line between the cavity 515-*c* and the cavity 515-*d*).

The sight component 510 may be coupled to the slide cover 505 based on the retainer 530-*a*. For example, the retainer 530-*a* (e.g., a friction pin) may be located inside the cavity 525-*a*, the cavity 525-*b*, and the cavity 525-*c*. The sight component 510 may be coupled to the slide cover 505 based on the retainer 540-*a* being used in additional to or instead of the retainer 530-*a*. For example, the retainer 540-*a* (e.g., a screw) may be located inside the cavity 535-*a* and the cavity 535-*b*. The retainer 540-*a* may be used in a vertical orientation (e.g., perpendicular to retainer 530-*a*), which may reduce movement of the sight component 510 with respect to the slide cover 505, thereby improving reducing sight oscillation and improving accuracy.

Figure 6:
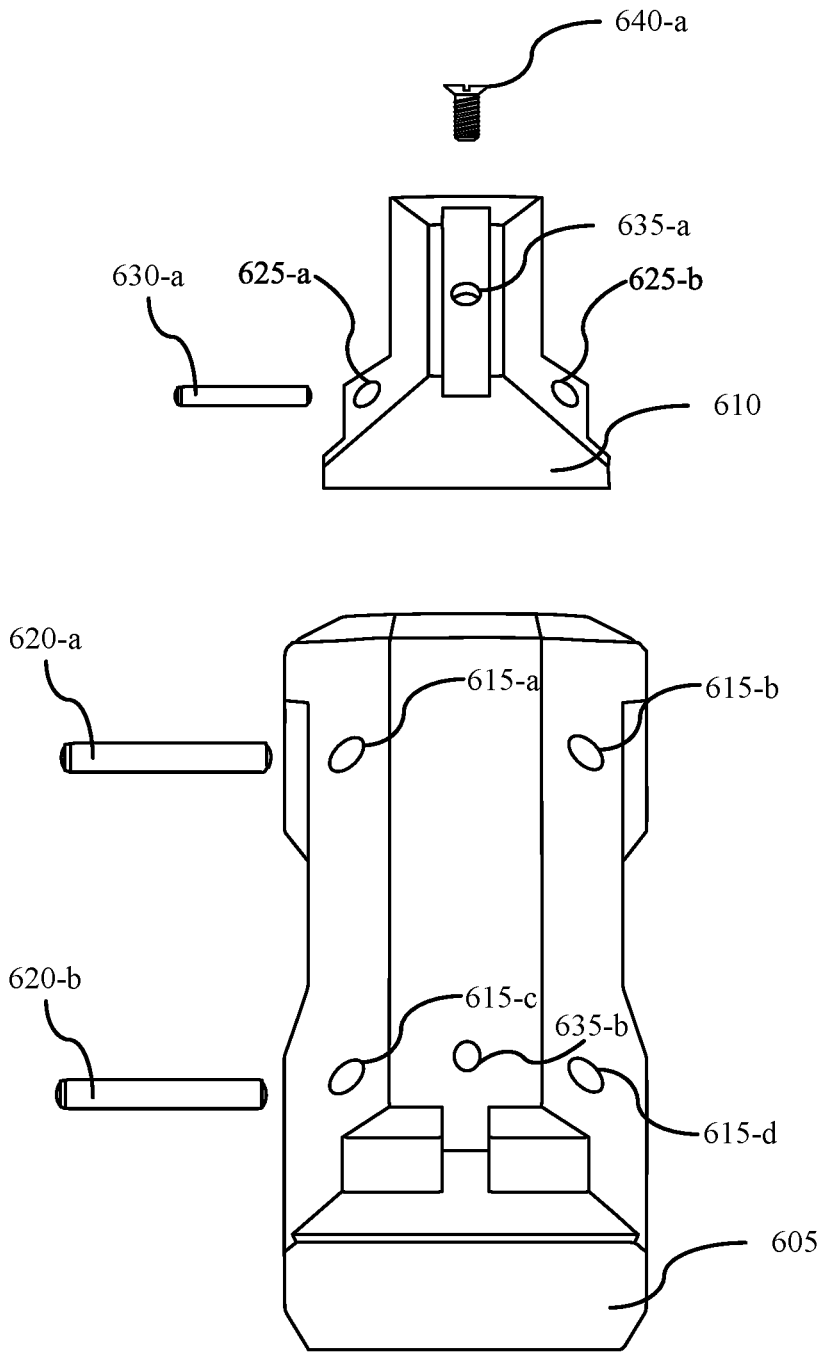
FIG. 6 illustrates an example of an exploded view of a slide cover that supports a weapon slide cover in accordance with aspects of the present disclosure.

FIG. 6 illustrates an example of an exploded view 600 of a slide cover. The exploded view 600 includes the slide cover 605, the sight component 610, multiple cavities (e.g., a cavity 615-*a*, a cavity 615-*b*, a cavity 615-*c*, a cavity 615-*d*, a cavity 625-*a*, a cavity 625-*b*, a cavity 635-*a*, and a cavity 635-*b*), and multiple retainers (e.g., a retainer 620-*a*, a retainer 620-*b*, a retainer 630-*a*, and a retainer 640-*a*. The sight component 610 is an example of an iron sight (a rear iron sight, an open sight, an aperture sight, etc.) that may be coupled with the slide cover 605, but it should be understood that various types of sight components (e.g., sight mounting components, picatinny rails, telescopic sights, red dot sights reflex sights, holographic sights, etc.) may be coupled with the slide cover 605.

The exploded view 600 is a rearward view of an example of a slide cover. The slide cover 605 may be coupled with the sight component 610 based on one or more retainers, allowing users to modify, adjust, or replace the sight component 610, thereby improving user experience.

Figure 7:
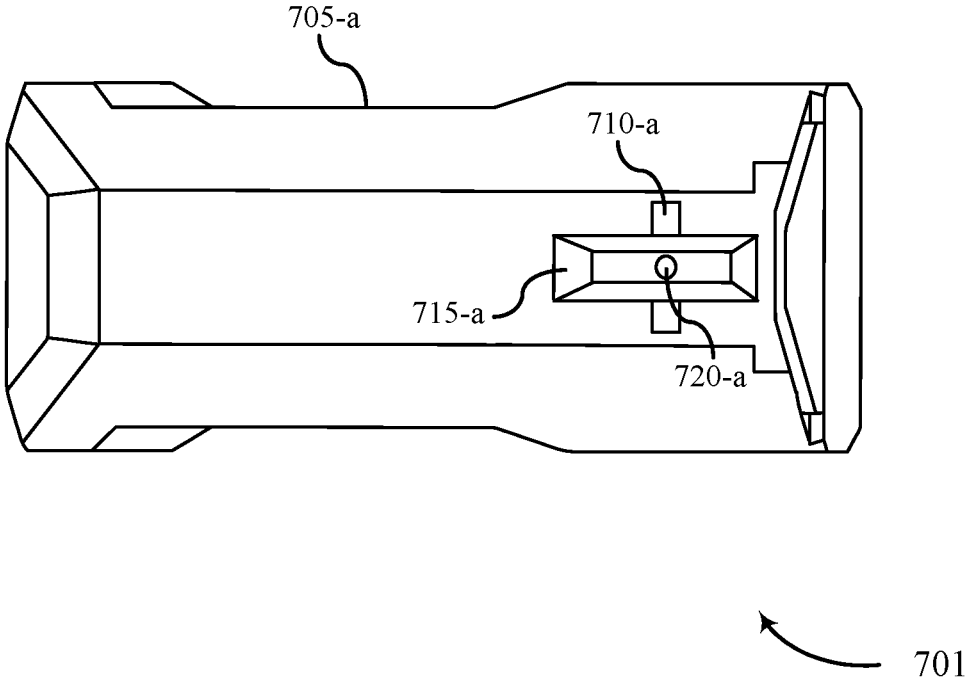
FIG. 7 illustrates examples of vertical views of slide covers that support a weapon slide cover in accordance with aspects of the present disclosure.
Figure 7:
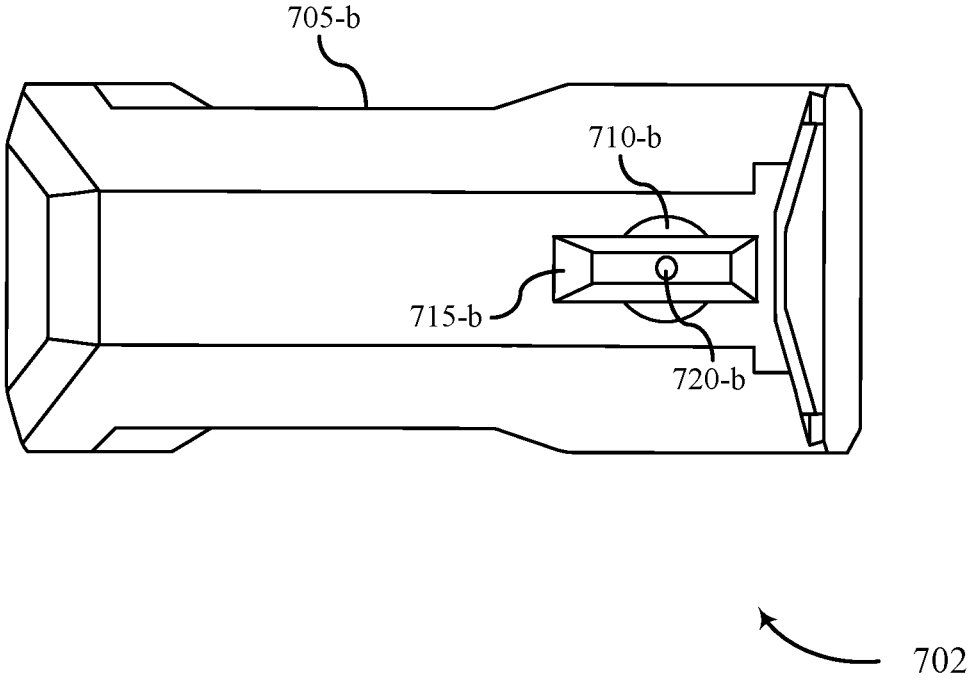

FIG. 7 illustrates an example of a vertical view 701 of a slide cover and an example of a vertical view 702 of a slide cover. The slide cover 705-*a* and the slide cover 705-*b* both support adjustable sight components, allowing users to adjust sight components to account variables such as wind speed, distance to target, or user preference.

The vertical view 701 includes the slide cover 705-*a*, a sight adjuster 710-*a*, a sight component 715-*a*, and a cavity 720-*a*. The sight component 715-*a* may be an example of a sight, such as an iron sight, a telescopic sight, a reflex sight, a holographic sight, or the sight component 715-*a* may be an example of a sight mounting component, such as a sight mount that supports mounting a sight or a sight adapter that supports mounting different types of sights.

The sight adjuster 710-*a* may be a transverse rail supporting horizontal sight adjustment. For example, the sight adjuster 710-*a* and the sight component 715-*a* may be coupled via a dovetail system that allows the sight component 715-*a* to be displaced horizontally along the sight adjuster 710-*a*. In some cases, the slide cover 705-*a* may include the cavity 720-*a* to support mounting a scope or sight to the sight component 715-*a*, while in some other cases, the slide cover 705-*a* may not include the cavity 720-*a* (e.g., when the sight component 715-*a* is a sight that is coupled with the sight adjuster 710-*a*).

The vertical view 702 includes a slide cover 705-*b*, a sight adjuster 710-*b*, a sight component 715-*b*, and a cavity 720-*b*. The sight component 715-*b* may be an example of a sight, such as an iron sight, a telescopic sight, a reflex sight, a holographic sight, or the sight component 715-*b* may be an example of a sight mounting component, such as a sight mount that supports mounting a sight or a sight adapter that supports mounting different types of sights.

The sight adjuster 710-*b* may be a circular mount supporting rotational sight adjustment. For example, the sight adjuster 710-*b* and the sight component 715-*b* may be coupled via a mounting system that supports adjusting the sight component 715-*b* by rotating the sight component 715-*b* by up to 360 degrees. In some cases, the slide cover 705-*b* may include a cavity 720-*b* to support mounting a scope or sight to the sight component 715-*b*, while in some other cases, the slide cover 705-*b* may not include the cavity 720-*b* (e.g., when the sight component 715-*b* is a sight that is coupled with the sight adjuster 710-*b*).

Figure 8:
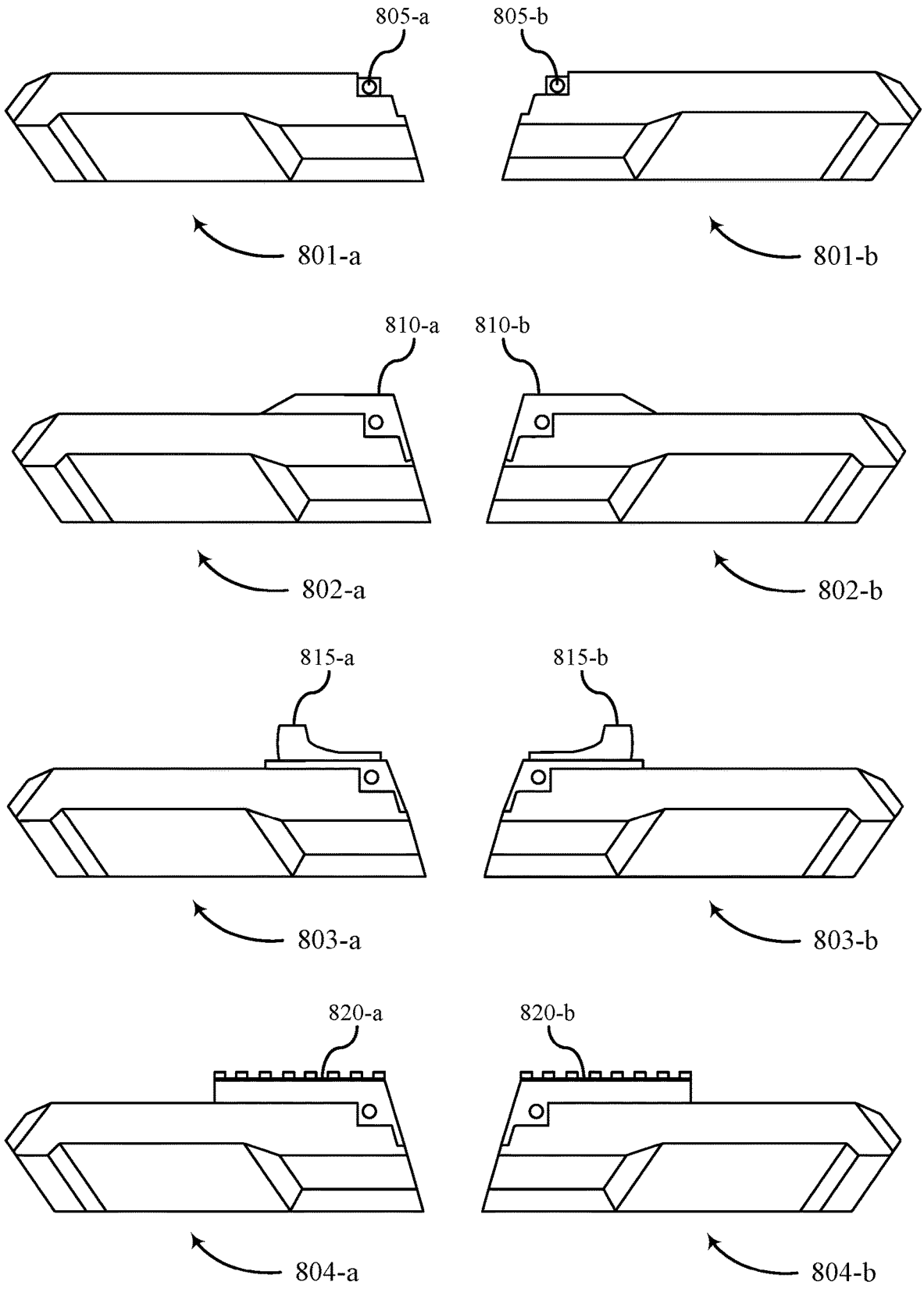
FIG. 8 illustrates examples of slide cover configurations that supports a weapon slide cover in accordance with aspects of the present disclosure.

FIG. 8 illustrates examples of slide covers with various sight components. FIG. 8 includes a slide cover 801-*a*, a slide cover 801-*b*, a slide cover 802-*a*, a slide cover 802-*b*, a slide cover 803-*a*, a slide cover 803-*b*, a slide cover 804-*a*, and a slide cover 804-*b*. The slide cover 801-*a*, the slide cover 802-*a*, the slide cover 803-*a*, and the slide cover 804-*a* are examples of left-side views of slide covers, while the slide cover 801-*b*, the slide cover 802-*b*, the slide cover 803-*b*, and the slide cover 804-*b* are examples of right-side views of slide covers.

The slide cover 801-*a* shows a left-side view of a slide cover as described herein. The slide cover 801-*a* includes a cavity 805-*a*, which may support coupling a sight component, such as a rear iron sight, a reflector sight, a mounting system (e.g., a picatinny rail, a sight adapter, etc.), or the like. The slide cover 801-*b* shows a right-side view of a slide cover as described herein. The slide cover 801-*b* includes a cavity 805-*b*, which may support coupling a sight component, such as a rear iron sight, a reflector sight, a mounting system (e.g., a picatinny rail, a sight adapter, etc.), or the like.

The slide cover 802-*a* shows a left-side view of a slide cover as described herein. The slide cover 802-*a* includes a rear iron sight 810-*a*, which may be an open rear sight or an aperture rear sight. The slide cover 802-*b* shows a right-side view of a slide cover as described herein. The slide cover 802-*b* includes a rear iron sight 810-*b*, which may be an open rear sight or an aperture rear sight.

The slide cover 803-*a* shows a left-side view of a slide cover as described herein. The slide cover 803-*a* includes an electronic sight 815-*a*, which may be a holographic sight or a reflector sight. The slide cover 803-*b* shows a right-side view of a slide cover as described herein. The slide cover 803-*b* includes an electronic sight 815-*b*, which may be a holographic sight or a reflector sight.

The slide cover 804-*a* shows a left-side view of a slide cover as described herein. The slide cover 804-*a* includes a rail system 820-*a*, which may be a picatinny rail system. The slide cover 804-*b* shows a right-side view of a slide cover as described herein. The slide cover 804-*b* includes a rail system 820-*b*, which may be a picatinny rail system. The slide covers described herein may support multiple types of sights, scopes, mounts, and adapters, such as telescopic scopes, thermal scopes, multiple mounts for multiple types of scopes, or the like.

Figure 9:
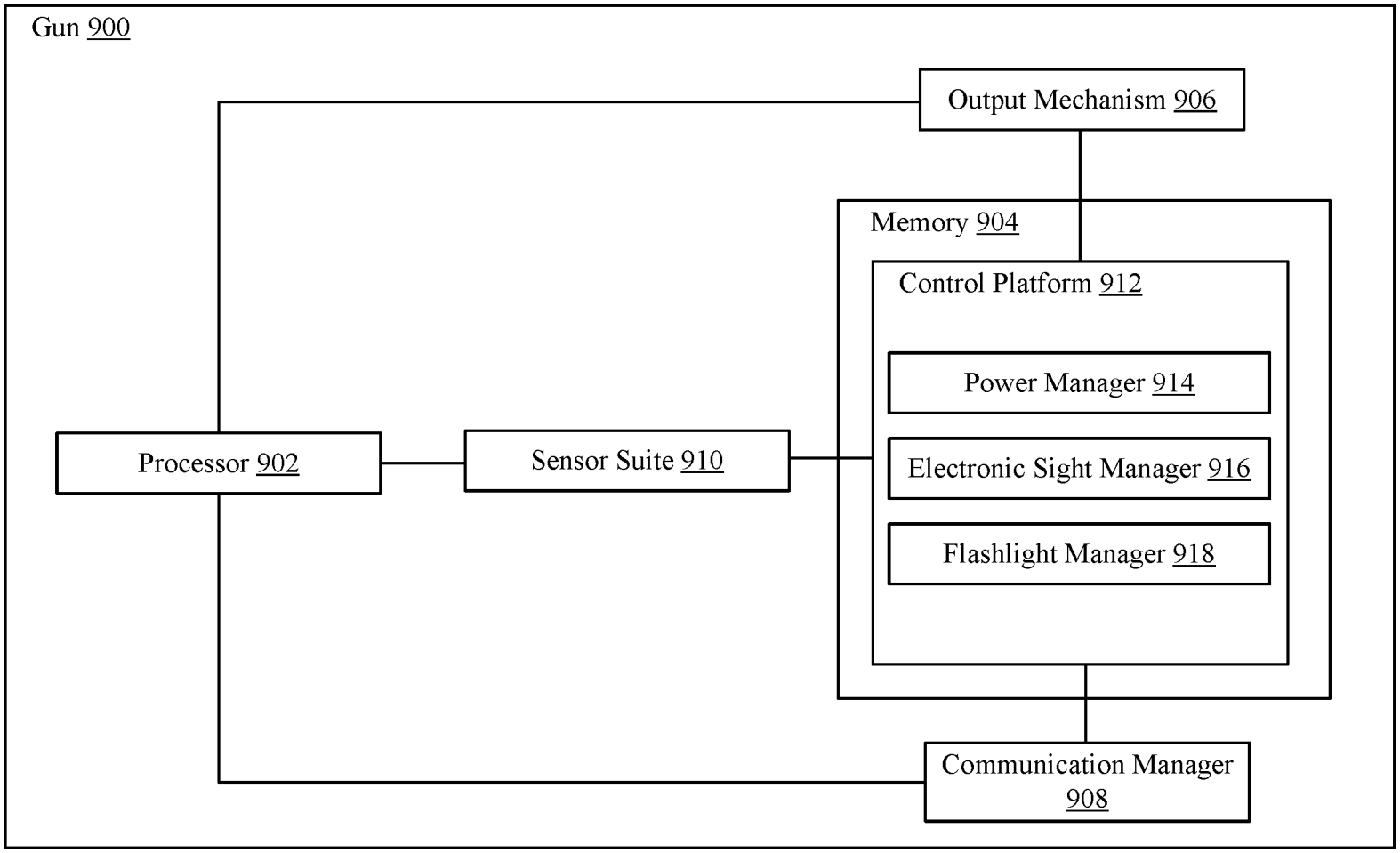
FIG. 9 illustrates an example of a gun that supports an electronic slide cover in accordance with aspects of the present disclosure.

FIG. 9 illustrates an example of a gun 900 able to implement a control platform 912 designed to produce outputs that are helpful managing electronic components of a slide cover. As further discussed below, the control platform 912 (also referred to as a "management platform" or a "signal manager") may be designed to provide power to and manage the function of one or more electronic components that are coupled with, or aspects of, a slide cover.

In some embodiments, the control platform 912 is embodied as a computer program that is executed by the gun 900. In other embodiments, the control platform 912 is embodied as an electrical circuit that performs logical operations of the gun 900. In yet other embodiments, the control platform 912 is embodied as a computer program that is executed by a computing device to which the gun 900 is communicatively connected. In such embodiments, the gun 900 may transmit relevant information to the computing device for processing as further discussed below. Those skilled in the art will recognize that aspects of the computer program could also be distributed amongst the gun 900 and computing device.

The gun 900 can include a processor 902, memory 904, output mechanism 906, and communication manager 908. The processor 902 can have generic characteristics similar to general-purpose processors, or the processor 902 may be an application-specific integrated circuit (ASIC) that provides control functions to the gun 900. As shown in FIG. 9, the processor 902 can be coupled with all components of the gun 900, either directly or indirectly, for communication purposes.

The memory 904 may be comprised of any suitable type of storage medium, such as static random-access memory (SRAM), dynamic random-access memory (DRAM), electrically erasable programmable read-only memory (EEPROM), flash memory, or registers. In addition to storing instructions that can be executed by the processor 902, the memory 904 can also store data generated by the processor 902 (e.g., when executing the managers of the control platform 912). Note that the memory 904 is merely an abstract representation of a storage environment. The memory 904 could be comprised of actual memory chips or managers.

The output mechanism 906 can be any component that is capable of conveying information to a user of the gun 900. For example, the output mechanism 906 may be a display panel (or simply "display") that includes LEDs, organic LEDs, liquid crystal elements, or electrophoretic elements. Alternatively, the display may simply be a series of illuminants (e.g., LEDs) that are able to indicate the status of the gun 900. Thus, the display may indicate whether the gun 900 is presently in a locked state, unlocked state, etc. As another example, the output mechanism 906 may be a loudspeaker (or simply "speaker") that is able to audibly convey information to the user.

The communication manager 908 may be responsible for managing communications between the components of the gun 900. Additionally or alternatively, the communication manager 908 may be responsible for managing communications with computing devices that are external to the gun 900. Examples of computing devices include mobile phones, tablet computers, wearable electronic devices (e.g., fitness trackers), and network-accessible server systems comprised of computer servers. Accordingly, the communication manager 908 may be wireless communication circuitry that is able to establish communication channels with computing devices. Examples of wireless communication circuitry include integrated circuits (also referred to as "chips") configured for Bluetooth, NFC, and the like.

Sensors are normally implemented in the gun 900. Collectively, these sensors may be referred to as the "sensor suite" 910 of the gun 900. For example, the gun 900 may include a motion sensor whose output is indicative of motion of the gun 900 as a whole. Examples of motion sensors include multi-axis accelerometers and gyroscopes. As another example, the gun 900 may include a proximity sensor whose output is indicative of proximity of the gun 900 to a nearest obstruction within the field of view of the proximity sensor. A proximity sensor may include, for example, an emitter that is able to emit infrared (IR) light and a detector that is able to detect reflected IR light that is returned toward the proximity sensor. These types of proximity sensors are sometimes called laser imaging, detection, and ranging (LiDAR) scanners. As another example, the gun 900 may include a fingerprint sensor or camera that generates images which can be used for, for example, biometric authentication. As shown in FIG. 9, outputs produced by the sensor suite 910 may be provided to the control platform 912 for examination or analysis.

For convenience, the control platform 912 may be referred to as a computer program that resides in the memory 904. However, the control platform 912 could be comprised of software, firmware, or hardware components that are implemented in, or accessible to, the gun 900. In accordance with embodiments described herein, the control platform 912 may include a power manager 914, an electronic sight manager 916, and a flashlight manager 918. As an illustrative example, the power manager 914 may manage power delivery to electronic components, the electronic sight manager 916 may manage an electronic sight, and the flashlight manager 918 may manage a flashlight. Because the data obtained by these managers may have different formats, structures, and content, the instructions executed by these managers can (and often will) be different. For example, the instructions executed by the power manager 914 to deliver power to electronic components in a reliable manner may be different than the instructions generated by manager electronic sight manager 916 to manage an electronic sight.

Figure 10:
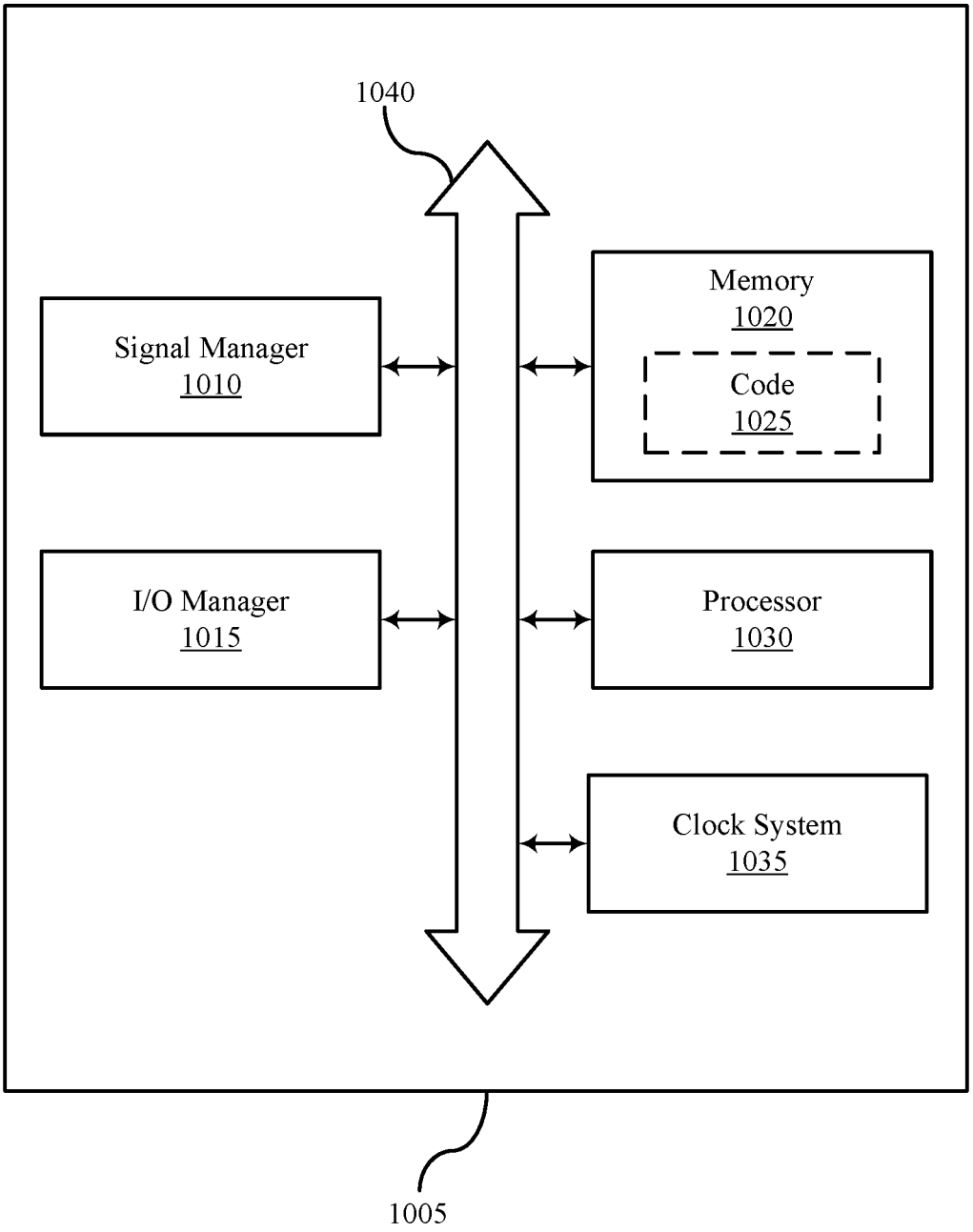
FIG. 10 illustrates an example of a system that may be an aspect of a gun described herein.

FIG. 10 illustrates an example of a system 1000 that may be an aspect of a gun. The device 1005 may be operable to implement the techniques, technology, or systems disclosed herein. The device 1005 may include components such as a signal manager 1010, an input/output (I/O) manager 1015, memory 1020, code 1025, a processor 1030, a clock system 1035, and a bus 1040. The components of the device 1005 may communicate via one or more buses 1040. The device 1005 may be an example of, or include components of, a gun or a slide cover.

The signal manager 1010 may transmit and/or receive data packets over a physical communication channel, such as a wire, an optical cable, another physical medium. The physical communication channel may electronically couple aspects of the device 1005. For example, the physical communication channel may electronically couple a gun with a electronic components of a slide cover, such as a sight component. In some examples, the signal manager 1010 may control the functions of one or more aspects of a slide cover. For example, the signal manager 1010 may provide power to an electronic sight, provide power to a picatinny rail, transmit a data packet so as to modify the brightness or color of a sight component, or the like.

The I/O manager 1015 may manage input and output signals for the device 1005. The I/O manager 1015 may also manage various peripherals such an input device (e.g., a button, a switch, a touch screen, a dock, a biometric sensor, a pressure sensor, a heat sensor, a proximity sensor, an RFID sensor, etc.) and an output device (e.g., a monitor, a display, an LED, a speaker, a haptic motor, a heat pipe, etc.).

The memory 1020 may include or store code (e.g., software) 1025. The memory 1020 may include volatile memory, such as random-access memory (RAM) and/or non-volatile memory, such as read-only memory (ROM). The code 1025 may be computer-readable and computer-executable, and when executed, the code 1025 may cause the processor 1030 to perform various operations or functions described here.

The processor 1030 may be an example or component of a central processing unit (CPU), an application specific integrated circuit (ASIC), or a field programmable gate array (FPGA). In some embodiments, the processor 1030 may utilize an operating system or software such as Microsoft Windows®, iOS®, Android®, Linux®, Unix®, or the like. The clock system 1035 control a timer for use by the disclosed embodiments.

The signal manager 1010, or its sub-components, may be implemented in hardware, software (e.g., software or firmware) executed by a processor, or a combination thereof. The signal manager 1010, or its sub-components, may be physically located in various positions. For example, in some cases, the signal manager 1010, or its sub-components may be distributed such that portions of functions are implemented at different physical locations by one or more physical components.

Figure 11:
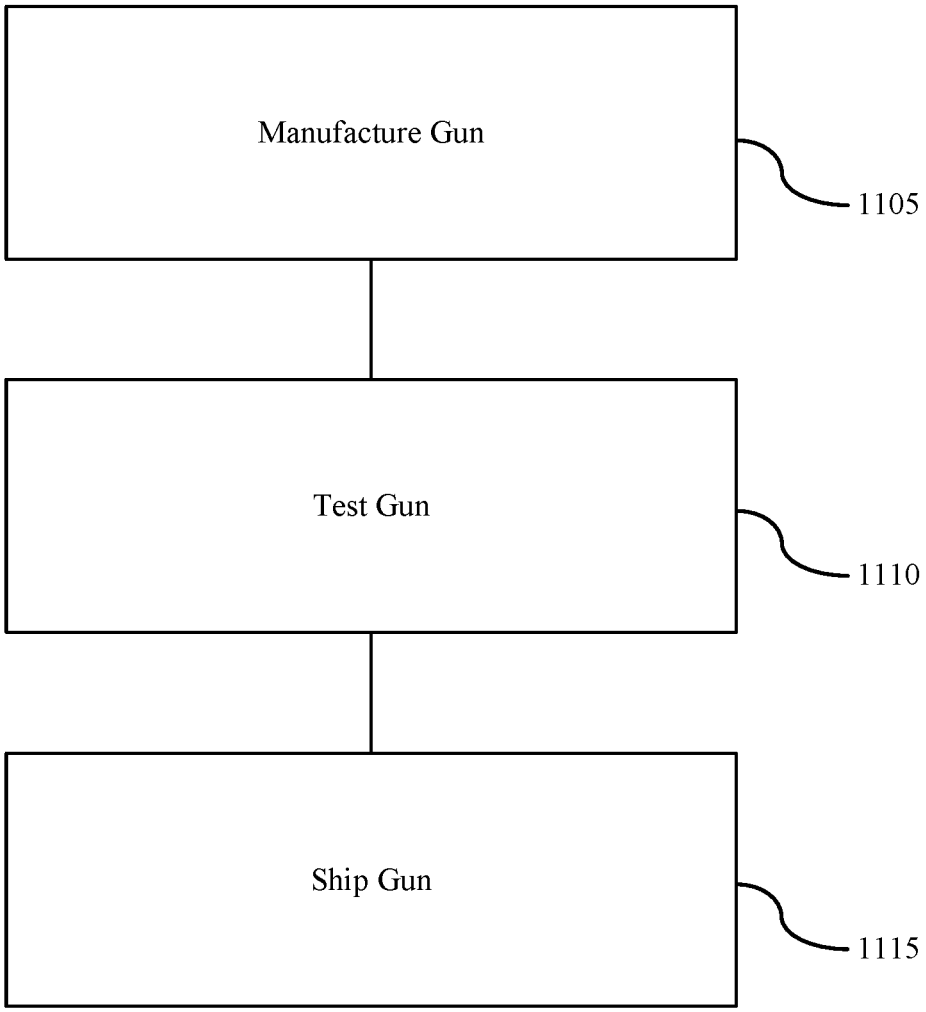
FIG. 11 illustrates an example of a flowchart showing a method of manufacturing a gun that includes a slide cover.

FIG. 11 illustrates an example of a flowchart 1100 showing a method of manufacturing a gun that includes a slide cover. The method shown in the flowchart 1100 may be used to manufacture a slide component, a gun, or both. Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Initially, a gun manufacturer (or simply "manufacturer") may manufacture a gun that is able to implement aspects of the present disclosure (step 1105). For example, the manufacturer may machine, cut, shape, or otherwise make parts to be included in the gun. Thus, the manufacturer may also design those parts before machining occurs, or the manufacturer may verify designs produced by another entity before machining occurs. Additionally or alternatively, the manufacturer may obtain parts that are manufactured by one or more other entities. Thus, the manufacturer may manufacture the gun from components produced entirely by the manufacturer, components produced by other entities, or a combination thereof. Often, the manufacturer will obtain some parts and make other parts that are assembled together to form the gun (or a component of the gun).

The manufacturer may develop a slide cover. In some examples, the slide cover may be fastened to a gun, and the manufacturer may verify the connection between the slide cover and the gun. The manufacturer may also develop instructions that support performing functions at the slide cover. For example, the manufacturer may produce software and/or firmware that supports measuring ambient light and modifying the brightness of an electronic sight of the slide cover based on the amount of ambient light measured.

In some embodiments, the manufacturer also generates identifying information related to the gun. For example, the manufacturer may etch (e.g., mechanically or chemically), engrave, or otherwise append identifying information onto the gun itself. As another example, the manufacturer may encode at least some identifying information into a data structure that is associated with the gun. For instance, the manufacturer may etch a serial number onto the gun, and the manufacturer may also populate the serial number (and other identifying information) into a data structure for recording or tracking purposes. Examples of identifying information include the make of the gun, the model of the gun, the serial number, the type of projectiles used by the gun, the caliber of those projectiles, the type of firearm, the barrel length, and the like. In some cases, the manufacturer may record a limited amount of identifying information (e.g., only the make, model, and serial number), while in other cases the manufacturer may record a larger amount of identifying information.

The manufacturer may then test the gun (step 1110). In some embodiments, the manufacturer tests all of the guns that are manufactured. In other embodiments, the manufacturer tests a subset of the guns that are manufactured. For example, the manufacturer may randomly or semi-randomly select guns for testing, or the manufacturer may select guns for testing in accordance with a predefined pattern (e.g., one test per 5 guns, 10 guns, or 100 guns). Moreover, the manufacturer may test the gun in its entirety, or the manufacturer may test a subset of its components. For example, the manufacturer may test the component(s) that it manufactures. As another example, the manufacturer may test newly designed components or randomly selected components. Thus, the manufacturer could test select component(s) of the gun, or the manufacturer could test the gun as a whole. For example, the manufacturer may test the barrel to verify that it meets a precision threshold and the cartridge feed system to verify that it meets a reliability threshold. As another example, the manufacturer may test a group of guns (e.g., all guns manufactured during an interval of time, guns selected at random over an interval of time, etc.) to ensure that those guns fire at a sufficiently high pressure (e.g., 70,000 pounds per square inch (PSI)) to verify that a safety threshold is met.

Thereafter, the manufacturer may ship the gun to a dealer (step 1115). In the event that the gun is a firearm, the manufacturer may ship the gun to a Federal Firearms Licensed (FFL) dealer. For example, a purchaser (also referred to as a "customer") may purchase the apparatus through a digital channel or non-digital channel. Examples of digital channels include web browsers, mobile applications, and desktop applications, while examples of non-digital channels include ordering via the telephone and ordering via a physical storefront. In such a scenario, the gun may be shipped to the FFL dealer so that the purchaser can obtain the gun from the FFL dealer. The FFL dealer may be directly or indirectly associated with the manufacturer of the gun. For example, the FFL dealer may be a representative of the manufacturer, or the FFL dealer may sell and distribute guns on behalf of the manufacturer (and possibly other manufacturers).

Note that while the sequences of the steps performed in the processes described herein are exemplary, the steps can be performed in various sequences and combinations. For example, steps could be added to, or removed from, these processes. Similarly, steps could be replaced or reordered. As an example, the manufacturer may iteratively test components while manufacturing the gun, and therefore perform multiple iterations of steps 1105 and 1110 either sequentially or simultaneously (e.g., one component may be tested while another component is added to the gun). Thus, the descriptions of these processes are intended to be open ended.

Examples

In some examples, the techniques described herein relate to a gun including: a slide that is coupled with a frame of the gun, wherein the slide includes a first slide aperture and a second slide aperture; a slide cover that is coupled with the slide, wherein the slide cover includes a first slide cover aperture and a second slide cover aperture, wherein a first difference in size between the first slide cover aperture and the first slide aperture satisfies a similarity threshold, and wherein a second difference in size between the second slide cover aperture and the second slide aperture satisfies the similarity threshold; a first retaining pin that is configured to affix the slide cover to the slide based on the first retaining pin being positioned inside the first slide cover aperture and the first slide aperture such that the first retaining pin is in contact with an interior edge of the first slide cover aperture and an interior edge of the first slide aperture; a second retaining pin that is configured to affix the slide cover to the slide based on the second retaining pin being positioned inside the second slide cover aperture and the second slide aperture such that the second retaining pin is in contact with an interior edge of the second slide cover aperture and an interior edge of the second slide aperture; and a third retaining pin that is configured to affix a sight component with the slide cover based on the third retaining pin being positioned such that the third retaining pin is perpendicular to both the first retaining pin and the second retaining pin.

In some examples, the techniques described herein relate to a slide cover that is removably coupled with a slide of a gun, the slide cover including: a top surface having a first longitudinal axis defined therethrough, wherein a sight component is coupled with the top surface based on a sight retainer coupling the sight component with the top surface such that a second longitudinal axis defined through the sight component is parallel with the first longitudinal axis; a first slide cover aperture that includes a first aperture of a first surface of the slide cover and a first aperture of a second surface of the slide cover, wherein a first difference in size between the first aperture of the first surface and the first aperture of the second surface satisfies a similarity threshold; and a second slide cover aperture that includes a second aperture of the first surface of the slide cover and a second aperture of the second surface of the slide cover, wherein a second difference in size between the second aperture of the first surface and the second aperture of the second surface satisfies the similarity threshold.

In some examples, the techniques described herein relate to a slide cover, further including: a first slide cover retainer that is positioned inside first slide cover aperture so as to affix the slide cover to the slide of the gun.

In some examples, the techniques described herein relate to a slide cover, wherein the first slide cover retainer is perpendicular to the sight retainer.

In some examples, the techniques described herein relate to a slide cover, further including: a first grip portion that is encompassed within the first surface of the slide cover.

In some examples, the techniques described herein relate to a slide cover, wherein the first grip portion is associated with a first frictional coefficient, and wherein a region of the first surface that is excluded from the first grip portion is associated with a second frictional coefficient that is lower than the first frictional coefficient.

In some examples, the techniques described herein relate to a slide cover, wherein the first grip portion is recessed towards the first longitudinal axis as compared to a region of the first surface that is excluded from the first grip portion.

In some examples, the techniques described herein relate to a slide cover, wherein the first grip portion protrudes away from the first longitudinal axis as compared to a region of the first surface that is excluded from the first grip portion.

In some examples, the techniques described herein relate to a slide cover, further including: a second grip portion that is encompassed within the second surface of the slide cover.

In some examples, the techniques described herein relate to a slide cover, wherein the second grip portion is symmetrical with the first grip portion.

In some examples, the techniques described herein relate to a slide cover, wherein the slide of the gun includes: a first slide aperture of a first surface of the slide, wherein a slide aperture property of the slide matches a slide cover aperture property of the slide cover.

In some examples, the techniques described herein relate to a slide cover, further including: a slide cover retaining pin that couples the slide cover with the slide based on an exterior surface of the slide cover retaining pin contacting both an interior surface of the first slide cover aperture and an interior surface of the first slide aperture.

In some examples, the techniques described herein relate to a slide cover, further including: a first breechblock aperture of a first surface of a breechblock, wherein a breechblock aperture property of the breechblock matches a slide cover aperture property of the slide cover.

In some examples, the techniques described herein relate to a slide cover, further including: a slide cover retaining pin that couples the slide cover with the breechblock based on an exterior surface of the slide cover retaining pin contacting both an interior surface of the first slide cover aperture and an interior surface of the first breechblock aperture.

In some examples, the techniques described herein relate to a slide cover, wherein the slide aperture property matches the slide cover aperture property based on a difference in size between the slide aperture property and the slide cover aperture property being less than a threshold.

In some examples, the techniques described herein relate to a slide cover, wherein the slide aperture property and the slide cover aperture property are radiuses, diameters, or circumferences.

In some examples, the techniques described herein relate to a slide cover, wherein the threshold is 0.01 millimeters, 0.1 millimeters, 0.5 millimeters, 1 millimeter, 2 millimeters, or 3 millimeters.

In some examples, the techniques described herein relate to a slide cover, wherein the breechblock aperture property matches the slide cover aperture property based on a difference in size between the breechblock aperture property and the slide cover aperture property being less than a threshold.

In some examples, the techniques described herein relate to a slide cover, wherein the breechblock aperture property and the slide cover aperture property are radiuses, diameters, or circumferences.

In some examples, the techniques described herein relate to a slide cover, further wherein the threshold is 0.01 millimeters, 0.1 millimeters, 0.5 millimeters, 1 millimeter, 2 millimeters, or 3 millimeters.

In some examples, the techniques described herein relate to a slide cover, wherein the slide cover includes plastic, polymer, carbon fiber, metal, alloy, silicon, rubber, or any combination thereof.

Remarks

The Detailed Description provided herein, in connection with the drawings, describes example configurations and does not represent all the examples that may be implemented or that are within the scope of the claims. The term "example" used herein means "serving as an illustration or instance," and not "a preferred example."

The functions described herein may be implemented with a controller. A controller may include a signal manager, a special-purpose processor, a general-purpose processor, a digital signal processor (DSP), a CPU, a graphics processing unit (GPU), a microprocessor, a tensor processing unit (TPU), a neural processing unit (NPU), an image signal processor (ISP), a hardware security module (HSM), an ASIC, a programmable logic device (such as an FPGA), a state machine, a circuit (such as a circuit including discrete hardware components, analog components, or digital components), or any combination thereof. Some aspects of a controller may be programmable, while other aspects of a control may not be programmable. In some examples, a digital component of a controller may be programmable (such as a CPU), and in some other examples, an analog component of a controller may not be programmable (such as a differential amplifier).

In some cases, instructions or code for the functions described herein may be stored on or transmitted over a computer-readable medium, and components implementing the functions may be physically located at various locations. Computer-readable media includes both non-transitory computer storage media and communication media. A non-transitory storage medium may be any available medium that may be accessed by a computer or component. For example, non-transitory computer-readable media may include RAM, SRAM, DRAM, ROM, EEPROM, flash memory, magnetic storage devices, or any other non-transitory medium that may be used to carry and/or store program code means in the form of instructions and/or data structures. The instructions and/or data structures may be accessed by a special-purpose processor, a general-purpose processor, a manager, or a controller. A computer-readable media may include any combination of the above, and a compute component may include computer-readable media.

In the context of the specification, the term "left" means the left side of the gun when the gun is held in an upright position, where the term "upright position" generally refers to a scenario in which the gun is oriented as if in a high-ready position with the barrel roughly parallel to the ground. The term "right" means the right side of the gun when the gun is held in the upright position. The term "front" means the muzzle end (also referred to as the "distal end") of the gun, and the term "back" means the grip end (also referred to as the "proximal end") of the gun. The terms "top" and "bottom" mean the top and bottom of the gun as the gun is held in the upright position. The relative positioning terms such as "left," "right," "front," and "rear" are used to describe the relative position of components. The relative positioning terms are not intended to be limiting relative to a gravitational orientation, as the relative positioning terms are intended to be understood in relation to other components of the gun, in the context of the drawings, or in the context of the upright position described above.

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Although the Detailed Description describes certain embodiments and the best mode contemplated, the technology can be practiced in many ways no matter how detailed the Detailed Description appears. Embodiments may vary considerably in their implementation details, while still being encompassed by the specification. Particular terminology used when describing certain features or aspects of various embodiments should not be taken to imply that the terminology is being redefined herein to be restricted to any specific characteristics, features, or aspects of the technology with which that terminology is associated. In general, the terms used in the following claims should not be construed to limit the technology to the specific embodiments disclosed in the specification, unless those terms are explicitly defined herein. Accordingly, the actual scope of the technology encompasses not only the disclosed embodiments, but also all equivalent ways of practicing or implementing the embodiments.

The language used in the specification has been principally selected for readability and instructional purposes. It may not have been selected to delineate or circumscribe the subject matter. It is therefore intended that the scope of the technology be limited not by this Detailed Description, but rather by any claims that issue on an application based hereon. Accordingly, the disclosure of various embodiments is intended to be illustrative, but not limiting, of the scope of the technology as set forth in the following claims.

What is claimed is:

1. A gun comprising:

a slide that is coupled with a frame of the gun, wherein the slide includes a first slide aperture and a second slide aperture;

a slide cover that is coupled with the slide, wherein the slide cover includes a first slide cover aperture and a second slide cover aperture, wherein a first difference in size between the first slide cover aperture and the first slide aperture satisfies a similarity threshold, and wherein a second difference in size between the second slide cover aperture and the second slide aperture satisfies the similarity threshold;

a first retaining pin that is configured to affix the slide cover to the slide based on the first retaining pin being positioned inside the first slide cover aperture and the first slide aperture such that the first retaining pin is in contact with an interior edge of the first slide cover aperture and an interior edge of the first slide aperture;

a second retaining pin that is configured to affix the slide cover to the slide based on the second retaining pin being positioned inside the second slide cover aperture and the second slide aperture such that the second retaining pin is in contact with an interior edge of the second slide cover aperture and an interior edge of the second slide aperture; and a third retaining pin that is configured to affix a sight component with the slide cover based on the third retaining pin being positioned such that the third retaining pin is perpendicular to both the first retaining pin and the second retaining pin.

2. A slide cover that is removably couplable with a slide of a gun, the slide cover comprising:

a top surface having a first longitudinal axis defined therethrough, wherein a sight component is coupled with the top surface based on a sight retainer coupling the sight component with the top surface such that a second longitudinal axis defined through the sight component is parallel with the first longitudinal axis;

a first slide cover aperture that includes a first aperture of a first surface of the slide cover and a first aperture of a second surface of the slide cover, wherein a first difference in size between the first aperture of the first surface and the first aperture of the second surface satisfies a similarity threshold;

a second slide cover aperture that includes a second aperture of the first surface of the slide cover and a second aperture of the second surface of the slide cover, wherein a second difference in size between the second aperture of the first surface and the second aperture of the second surface satisfies the similarity threshold; and a first grip portion that is encompassed within the first surface of the slide cover, wherein the first grip portion is associated with a first frictional coefficient, and wherein a region of the first surface that is excluded from the first grip portion is associated with a second frictional coefficient that is lower than the first frictional coefficient.

3. The slide cover of claim 2, further comprising:

a first slide cover retainer that is positioned inside the first slide cover aperture so as to affix the slide cover to the slide of the gun.

4. The slide cover of claim 3, wherein the first slide cover retainer is perpendicular to the sight retainer.

5. The slide cover of claim 2, wherein a slide cover aperture property of the slide cover matches a slide aperture property of the slide that comprises a first slide aperture of a first surface of the slide.

6. The slide cover of claim 5, further comprising:

a slide cover retaining pin that couples the slide cover with the slide based on an exterior surface of the slide cover retaining pin contacting both an interior surface of the first slide cover aperture and an interior surface of the first slide aperture.

7. The slide cover of claim 5, wherein the slide aperture property matches the slide cover aperture property based on a difference in size between the slide aperture property and the slide cover aperture property being less than a threshold.

8. The slide cover of claim 7, wherein the slide aperture property and the slide cover aperture property are radiuses, diameters, or circumferences.

9. The slide cover of claim 8, wherein the threshold is 0.01 millimeters, 0.1 millimeters, 0.5 millimeters, 1 millimeter, 2 millimeters, or 3 millimeters.

10. The slide cover of claim 2, wherein a slide cover aperture property of the slide cover matches a breechblock aperture property of a breechblock that comprises a first breechblock aperture of a first surface of the breechblock.

11. The slide cover of claim 10, further comprising:

a slide cover retaining pin that couples the slide cover with the breechblock based on an exterior surface of the slide cover retaining pin contacting both an interior surface of the first slide cover aperture and an interior surface of the first breechblock aperture.

12. The slide cover of claim 10, wherein the breechblock aperture property matches the slide cover aperture property based on a difference in size between the breechblock aperture property and the slide cover aperture property being less than a threshold.

13. The slide cover of claim 12, wherein the breechblock aperture property and the slide cover aperture property are radiuses, diameters, or circumferences.

14. The slide cover of claim 13, further wherein the threshold is 0.01 millimeters, 0.1 millimeters, 0.5 millimeters, 1 millimeter, 2 millimeters, or 3 millimeters.

15. The slide cover of claim 2, wherein the slide cover comprises plastic, polymer, carbon fiber, metal, alloy, silicon, rubber, or any combination thereof.

16. A slide cover that is removably couplable with a slide of a gun, the slide cover comprising:

a top surface having a first longitudinal axis defined therethrough, wherein a sight component is coupled with the top surface based on a sight retainer coupling the sight component with the top surface such that a second longitudinal axis defined through the sight component is parallel with the first longitudinal axis;

a first slide cover aperture that includes a first aperture of a first surface of the slide cover and a first aperture of a second surface of the slide cover, wherein a first difference in size between the first aperture of the first surface and the first aperture of the second surface satisfies a similarity threshold;

a second slide cover aperture that includes a second aperture of the first surface of the slide cover and a second aperture of the second surface of the slide cover, wherein a second difference in size between the second aperture of the first surface and the second aperture of the second surface satisfies the similarity threshold; and a first grip portion that is encompassed within the first surface of the slide cover, wherein the first grip portion is recessed towards the first longitudinal axis as compared to a region of the first surface that is excluded from the first grip portion.

17. A slide cover that is removably couplable with a slide of a gun, the slide cover comprising:

a top surface having a first longitudinal axis defined therethrough, wherein a sight component is coupled with the top surface based on a sight retainer coupling the sight component with the top surface such that a second longitudinal axis defined through the sight component is parallel with the first longitudinal axis;

a first slide cover aperture that includes a first aperture of a first surface of the slide cover and a first aperture of a second surface of the slide cover, wherein a first difference in size between the first aperture of the first surface and the first aperture of the second surface satisfies a similarity threshold;

a second slide cover aperture that includes a second aperture of the first surface of the slide cover and a second aperture of the second surface of the slide cover, wherein a second difference in size between the second aperture of the first surface and the second aperture of the second surface satisfies the similarity threshold; and a first grip portion that is encompassed within the first surface of the slide cover, wherein the first grip portion protrudes away from the first longitudinal axis as compared to a region of the first surface that is excluded from the first grip portion.

18. A slide cover that is removably couplable with a slide of a gun, the slide cover comprising:

a top surface having a first longitudinal axis defined therethrough, wherein a sight component is coupled with the top surface based on a sight retainer coupling the sight component with the top surface such that a second longitudinal axis defined through the sight component is parallel with the first longitudinal axis;

a first slide cover aperture that includes a first aperture of a first surface of the slide cover and a first aperture of a second surface of the slide cover, wherein a first difference in size between the first aperture of the first surface and the first aperture of the second surface satisfies a similarity threshold;

a second slide cover aperture that includes a second aperture of the first surface of the slide cover and a second aperture of the second surface of the slide cover, wherein a second difference in size between the second aperture of the first surface and the second aperture of the second surface satisfies the similarity threshold;

a first grip portion that is encompassed within the first surface of the slide cover; and, a second grip portion that is encompassed within the second surface of the slide cover.

19. The slide cover of claim 18, wherein the second grip portion is symmetrical with the first grip portion.

* * * * *